US005241846A

United States Patent [19]

Hoke

[11] Patent Number: 5,241,846

[45] Date of Patent: Sep. 7, 1993

[54] FLUSH MOUNTED LOCK PROTECTOR

[76] Inventor: A. Chyril Hoke, 207 E. Main St., Box 212, Bainbridge, Ind. 46105

[21] Appl. No.: 852,965

[22] Filed: Mar. 17, 1992

[51] Int. Cl.[5] ..... E05B 17/18

[52] U.S. Cl. ..... 70/455; 70/423

[58] Field of Search ..... 70/54–56, 70/423, 424, 455, DIG. 56; 292/DIG. 2, 251.5; 411/372, 377

[56] References Cited

U.S. PATENT DOCUMENTS

| | | | |
|---|---|---|---|
| 1,410,605 | 3/1922 | Schacht | 70/DIG. 56 X |
| 2,096,568 | 10/1937 | Snively | 70/455 |
| 2,904,985 | 9/1959 | Murphy | 70/455 X |
| 3,740,981 | 6/1973 | Patriquin | 70/455 |
| 4,023,388 | 5/1977 | Morvai | 70/455 |
| 4,154,072 | 5/1979 | Flaschar | 70/455 |
| 4,709,567 | 12/1987 | Applebaum | 70/455 |
| 4,825,673 | 5/1989 | Drake | 70/455 |
| 4,858,454 | 8/1989 | McAnulty, III | 70/455 |
| 5,003,795 | 4/1991 | Hoke | 70/455 X |
| 5,103,538 | 4/1992 | Ryder | 411/372 X |

FOREIGN PATENT DOCUMENTS

| | | | |
|---|---|---|---|
| 1902467 | 10/1970 | Fed. Rep. of Germany | 70/455 |
| 3509684 | 10/1986 | Fed. Rep. of Germany | 70/455 |
| 226025 | 4/1969 | Sweden | 70/455 |
| 2194582 | 3/1988 | United Kingdom | 70/455 |

*Primary Examiner*—Peter M. Cuomo
*Assistant Examiner*—Suzanne L. Dino
*Attorney, Agent, or Firm*—Woodard, Emhardt, Naughton, Moriarty & McNett

[57] ABSTRACT

A flush mounted lock protector is provided that includes two cup portions joined by a hinge. Each cup portion has an interengaging lip for sealing engagement with the other cup portion. The lower cup portion includes an access port for placement about a flush mounted lock and adhesive means to secure the device about the lock. The upper cup includes a tab and a raised depressible dome portion which allows the upper cup to be enlarged therefore releasing the sealing engagement with the lower cup and breaking any ice that may form about the invention.

8 Claims, 3 Drawing Sheets

FLUSH MOUNTED LOCK PROTECTOR

BACKGROUND OF THE INVENTION

This invention relates to devices for protecting flush mounted locks such as the locks found on the doors of automobiles. In particular, the invention concerns a lock protector that completely covers and seals the lock to protect the lock and the keyhole against invasion by the elements.

Flush mounted locks are used in a wide variety of applications. Probably the most significant use of a flush mounted lock is on the doors of automobiles. Locks of this variety are continually exposed to a wide range of weather conditions, such as rain, sleet, or snow which may accumulate inside the lock and freeze thus preventing the lock from being used. The most effective way to protect the lock from this type of malfunction is to prohibit the invasion of the elements through the keyhole of the lock. There is a need, therefore, for a device to protect the lock against the elements and particularly against invasion by water.

Many devices have been proposed in the past for shielding locks. An example of such a device can be found in my U.S. Pat. No. 5,003,795. This patent discloses a lock protector that may be used on flush mount locks. My prior device relies on contacted adherent means to provide a sealed envelope for a lock.

Other similar devices include the moisture protection device for key lock openings disclosed in U. S. Pat. No. 4,825,673 to Drake. The Drake device uses a magnet to hold an intermediate flexible rubber frame around the key lock mechanism. Thus a seal is created between the invention and the area immediately surrounding the key lock mechanism.

U. S. Pat. No. 4,858,454 to McAnulty, III discloses a door lock protecting device having a base which fits about the door lock and including a hinged cover to provide protection from the elements. This device utilizes magnets to hold the cover in sealing engagement with the base.

SUMMARY OF THE INVENTION

An improved flush mounted lock protector according to one embodiment of the present invention comprises a first cup portion that can be mounted about the key slot of the lock and a second cup portion that can be sealingly engaged to the first cup portion. The first cup portion includes a first cup sidewall and a base which defines an access port to the key slot. The second cup portion includes a second cup sidewall and a cap having a depressible dome.

Another feature of the present invention is a tab on the second cup portion which allows for the easy application of a lifting force.

Yet another feature of the present invention is that the first cup portion and second cup portion are joined by a hinge. Furthermore, the first cup portion, second cup portion, and the hinge can be formed from a single piece of material.

A further feature contemplates an enlarged plate that protects the area of the panel immediately adjacent to the key slot from scratches.

It is an object of the present invention to provide an improved flush mounted lock protector. Another object of the present invention is to provide a water tight sealing means to Protect a flush mount lock from the environment.

A further object of the present invention is accomplished by a flush mounted lock protector which has an enlarged plate to protect the area surrounding the lock from scratches. Related objects and advantages of the present invention will be apparent from the following description.

DESCRIPTION OF THE PREFERRED EMBODIMENT

Figure 1:
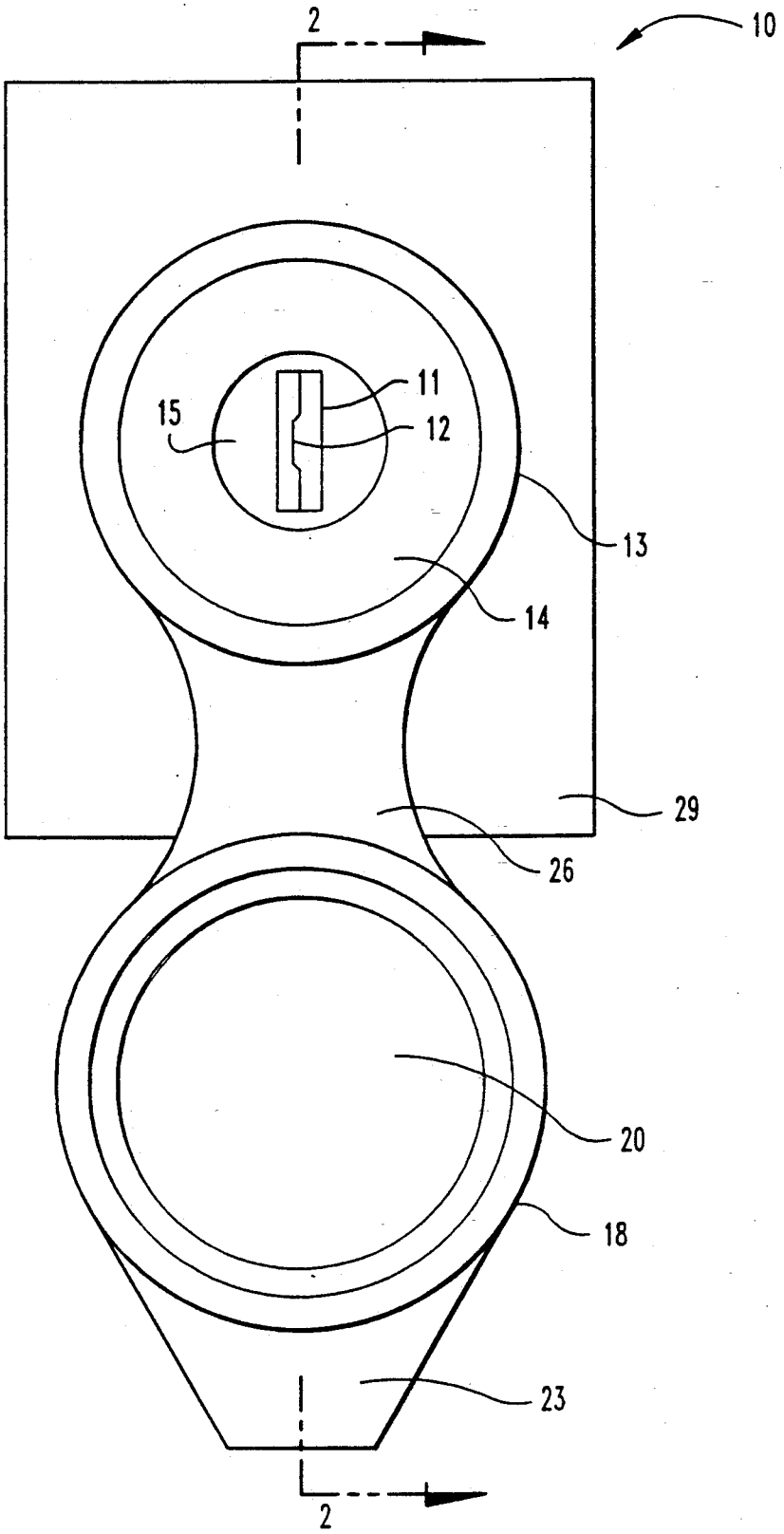
FIG. 1 is a plan view of the preferred embodiment of the flush mounted lock protector of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1 there is shown a lock protector 10 positioned about a flush mount lock 11. Flush mount lock 11 can be of the variety normally found on cars, trucks, tool boxes, mailboxes, and the like. Shown at the center of flush mount lock 11 is a key slot 12. The present invention is positioned about flush mount lock 11 to protect key slot 12 from the invasion of moisture and other debris.

Disposed about flush mount lock 11 is a first cup portion 13. First cup portion 13, as well as other components of the lock protector 10, may be manufactured of flexible polyvinylchloride or other similar weather resistant flexible material such as plastic. In the preferred embodiment of the invention, first cup portion 13 is circular in plan view and has a base 14 which defines a circular access port 15. It should be noted that the geometry of first cup portion 13 is determined in part by the geometry of the flush mount lock 11 and aesthetic considerations. In specific, access port 15 is configured so as to form a tight seal about flush mount lock 11.

Figure 2:
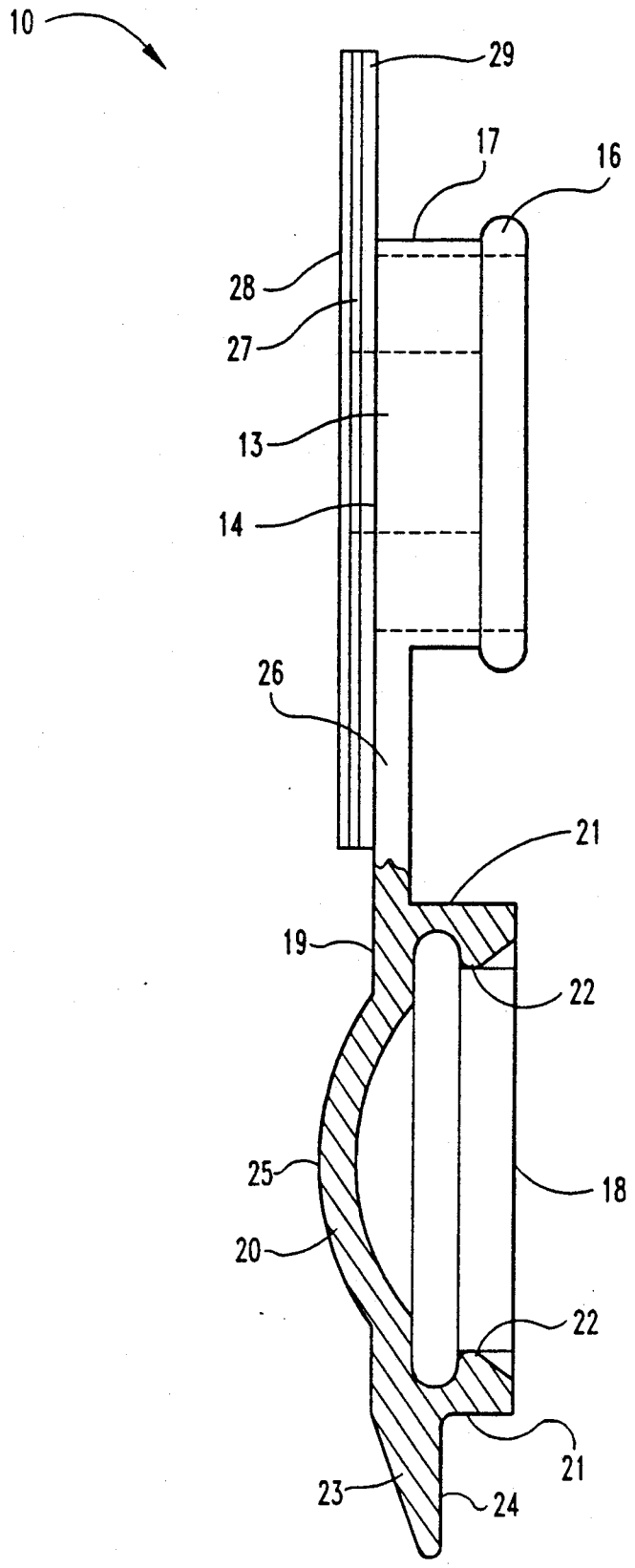
FIG. 2 is a partial sectional view of the lock protector of FIG. 1.

First cup portion 13 is shown in profile in FIG. 2. An enlarged lip 16 is connected to base 14 by a sidewall 17. It should be noted that in the preferred embodiment of the invention all of these elements are integrally formed from a single piece of material by molding or other such techniques.

Figure 3:
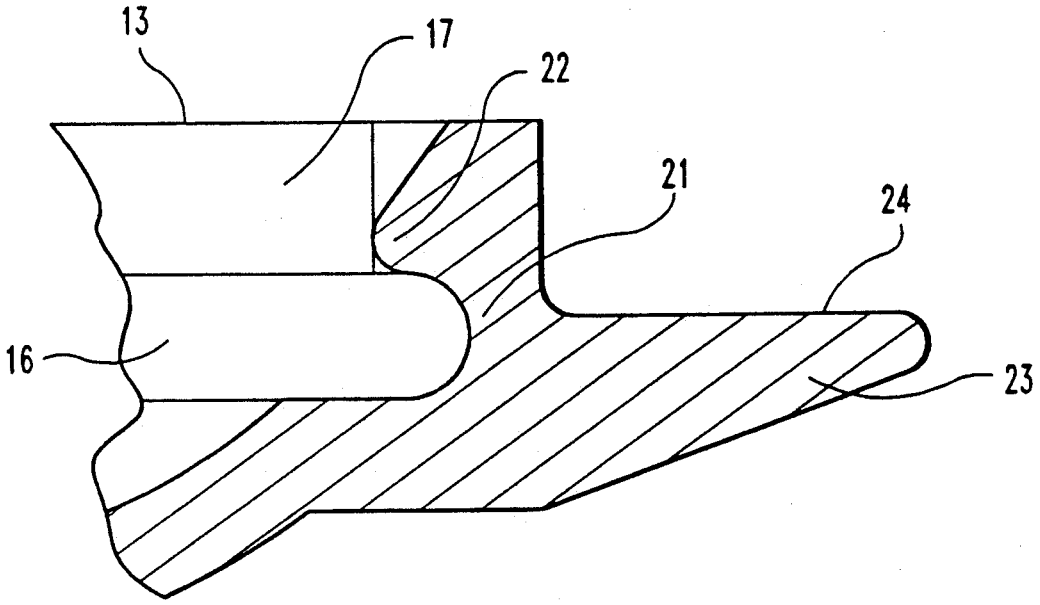
FIG. 3 is a enlarged sectional view of the sealing mechanism of the lock protector of FIG. 1.

Lock protector 10 also has a second cup portion 18 which is illustrated in FIGS. 1 and 2. Second cup portion 18 includes a cap 19 which has a depressible dome 20. Second cup portion 18 also includes a second sidewall 21 which may be sealing engaged to enlarged lip 16. A detail of this sealing engagement is shown in FIG. 3.

Additionally, second cup portion 18 includes a second cup enlarged lip 22. Second enlarged lip 22 is sized so that it may be sealingly engaged to first cup sidewall 17.

Second cup portion 18 is also provided with a tab 23 that provides a means of disengaging second cup portion 18 from first cup portion 13. To disengage the two cup portions, a lifting force is applied to the lower surface 24 of tab 23 while a downward force is applied to upper surface 25 of depressible dome 20. This combination of forces causes enlarged lip 16 to become disengaged from second sidewall 21 and second enlarged lip 22 to become disengaged from sidewall 17.

The use of depressible dome 20 in the present invention not only assists in disengaging the two cups but it also makes for easier access to the lock during icy weather conditions. It is not unusual for a thin sheet of ice or snow to form over flush mounted locks during winter weather conditions. A sheet of ice or snow covering the lock protector 10 of the present invention could be easily broken and displaced by pressing downward on depressible dome 20. Not only would the ice be broken above the dome by depressing it, but the ice formed around the periphery of the second cup portion 18 would also be broken due to the outward displacement of second cup sidewall 21.

First cup portion 13 and second cup portion 18 are connected by hinge portion 26. Hinge portion 26 is made of a pliable material so that it may flex as second cup portion 18 is rotated toward first cup portion 13. It should be noted that hinge portion 26 could also include with a pin type arrangement such as that of a mechanical hinge.

In the preferred embodiment of the invention, an adhesive 27 with a peel-off backing 28 is applied to the bottom of base 14. This arrangement is illustrated in FIG. 2.

The preferred embodiment of the invention also includes a scratch guard 29. It is not unusual, especially when it is dark outside, for a person to have difficulty in inserting the key in a flush mounted lock. This difficulty can result in scratching the surface immediately surrounding the lock. If the lock is of the type used in automobile car doors scratching of the surface around the lock can not only be aesthetically unpleasant but can cause surface corrosion. Scratch guard 29 of the present invention protects the area immediately surrounding the lock from this type of abuse. It should be noted that the size and shape of scratch guard 29 can be adjusted to fit the individual taste of the user as well as the different variety of locks that the invention may be used with. Furthermore, scratch guard 29 can be decorative in nature. An example of such decoration would be the use of an automobile logo or nameplate on the scratch guard.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A lock protector for protecting the key-slot of a lock flush-mounted within a panel comprising:

a first cup portion including;

a base which defines an access port adapted to permit access to the key slot when said first cup portion is disposed over the flush-mounted lock; and a generally cylindrical first cup sidewall integral with and projecting substantially perpendicularly from said base;

a first lip integral with and extending substantially perpendicularly radially outward from said first cup sidewall away from said access port; and means for mounting said first cup portion about the key-slot of the lock; and a second cup portion including;

a generally cylindrical second cup sidewall having means for sealingly engaging said first cup sidewall with said second cup sidewall which means includes a second lip integral with and projecting substantially perpendicularly radially inward from said second cup sidewall to define a groove configured to receive said first lip and to retain said first lip therein by said second lip;

a cap, integral with said second cup sidewall, larger than said access port of said first cup portion, and having means, including a depressible hollow dome, for displacing said second lip of said second cup sidewall outwardly away from said first lip of said first cup sidewall to release said means for sealingly engaging said first cup sidewall with said second cup sidewall, said dome having a concave inner surface, separate from said groove, facing towards said access port, whereby said concave inner surface flattens when said dome is depressed, to thereby release said means for sealingly engaging.

2. The lock protector of claim 1 wherein said second cup portion includes tab means for facilitating manually gripping and applying a lifting force to said second cup portion.

3. The lock protector of claim 1 wherein said first and second cup portions are joined by a hinge.

4. The lock protector of claim 3 wherein said first cup portion, said second cup portion, and said hinge are formed from a single piece of material.

5. The lock protector of claim 4 wherein said material is flexible polyvinylchloride.

6. The lock protector of claim 1 wherein said means for mounting includes an adhesive.

7. The lock protector of claim 6 wherein said adhesive includes a peel off backing.

8. The lock protector of claim 1 further comprising a plate associated with said first cup portion, said plate being larger in area than said first cup portion to protect the area of the panel immediately adjacent the key slot from scratches.

* * * * *